US009178261B2

(12) United States Patent
Boone et al.

(10) Patent No.: US 9,178,261 B2
(45) Date of Patent: Nov. 3, 2015

(54) VERTICAL MICROCOAXIAL INTERCONNECTS

(71) Applicants: Justin Boone, Lutz, FL (US); Subramanian Krishnan, Wesley Chapel, FL (US); Shekhar Bhansali, Tampa, FL (US)

(72) Inventors: Justin Boone, Lutz, FL (US); Subramanian Krishnan, Wesley Chapel, FL (US); Shekhar Bhansali, Tampa, FL (US)

(73) Assignee: University of South Florida, Tampa, FL (US)

( * ) Notice: Subject to any disclaimer, the term of this patent is extended or adjusted under 35 U.S.C. 154(b) by 0 days.

(21) Appl. No.: 14/047,191

(22) Filed: Oct. 7, 2013

(65) Prior Publication Data

US 2015/0035615 A1 Feb. 5, 2015

Related U.S. Application Data

(63) Continuation of application No. 13/939,614, filed on Jul. 11, 2013.

(60) Provisional application No. 61/670,231, filed on Jul. 11, 2012.

(51) Int. Cl.
*H01P 5/02* (2006.01)
*H01P 5/08* (2006.01)

(52) U.S. Cl.
CPC ..... *H01P 5/085* (2013.01)

(58) Field of Classification Search
CPC ..... H01P 3/003; H01P 3/10; H01P 5/085
USPC ..... 333/33
See application file for complete search history.

(56) References Cited

U.S. PATENT DOCUMENTS

| | | | | |
|---|---|---|---|---|
| 4,030,943 | A * | 6/1977 | Lee et al. | 438/122 |
| 4,982,171 | A * | 1/1991 | Figlia et al. | 333/157 |
| 6,086,383 | A | 7/2000 | Fasano et al. | |
| 6,239,385 | B1 | 5/2001 | Schwiebert et al. | |
| 6,281,587 | B1 | 8/2001 | Nogami et al. | |
| 6,281,704 | B2 | 8/2001 | Ngai et al. | |
| 7,057,474 | B2 * | 6/2006 | Miller | 333/164 |
| 7,351,660 | B2 | 4/2008 | Brewer et al. | |
| 7,656,037 | B2 | 2/2010 | Hommel et al. | |
| 7,798,817 | B2 | 9/2010 | Kohl et al. | |
| 8,143,976 | B2 * | 3/2012 | Wyland | 333/260 |
| 2004/0217830 | A1 * | 11/2004 | Hansen et al. | 333/246 |
| 2009/0267712 | A1 * | 10/2009 | Zhou et al. | 333/238 |
| 2011/0121923 | A1 * | 5/2011 | Chang et al. | 333/238 |

OTHER PUBLICATIONS

Vanhille et al., Balanced Low-loss Ka-Band mu-coaxial Hybrids, Jun. 2007, IEEE/MTT-S International Microwave Symposium, pp. 1157-1160.*

* cited by examiner

*Primary Examiner* — Stephen E Jones
*Assistant Examiner* — Scott S Outten
(74) *Attorney, Agent, or Firm* — Thomas | Horstemeyer, LLP

(57) ABSTRACT

In one embodiment, a vertical microcoaxial interconnect includes a dielectric substrate having a top side and a bottom side, an inner conductor extending through the substrate from its top side to its bottom side, an outer conductor that extends through the substrate from its top side to its bottom side, the outer conductor surrounding the inner conductor, a signal line extending to the inner conductor without contacting the outer conductor, and a ground line extending to the outer conductor without contacting the inner conductor or the signal line.

15 Claims, 5 Drawing Sheets

VERTICAL MICROCOAXIAL INTERCONNECTS

CROSS-REFERENCE TO RELATED APPLICATION(S)

This application is a continuation application of copendinq U.S. utility application entitled, "Vertical Microcoaxial Interconnects," having Ser. No. 13/939,614, filed Jul. 11, 2013, which claims priority to U.S. Provisional Application Ser. No. 61/670,231, filed Jul. 11, 2012, both which are hereby incorporated by reference in their entirety.

NOTICE OF GOVERNMENT-SPONSORED RESEARCH

This invention was made with Government support under 1203001, awarded by the National Science Foundation (NSF). The Government has certain rights in the invention.

BACKGROUND

Today's electronic devices often include three-dimensional integrated circuits having multiple layers of active and passive electronic components that must be integrated both horizontally and vertically into a single circuit. Vertical interconnects are needed to facilitate the electrical connections of the components on the separate layers. Unfortunately, current interconnects only provide an electrical transition to these components in high-frequency packaging systems. In addition, such interconnects often suffer from signal losses and surface connection issues.

BRIEF DESCRIPTION OF THE DRAWINGS

The present disclosure may be better understood with reference to the following figures. Matching reference numerals designate corresponding parts throughout the figures, which are not necessarily drawn to scale.

DETAILED DESCRIPTION

As described above, three-dimensional integrated circuits have multiple layers of active and passive electronic components that must be vertically integrated into a single circuit and vertical interconnects are needed to facilitate the electrical connections between components on separate layers. Disclosed herein are embodiments of a vertical microcoaxial interconnect that can be used in such integrated circuits.

In the following disclosure, various specific embodiments are described. It is to be understood that those embodiments are example implementations of the disclosed inventions and that alternative embodiments are possible. All such embodiments are intended to fall within the scope of this disclosure.

Figure 1:
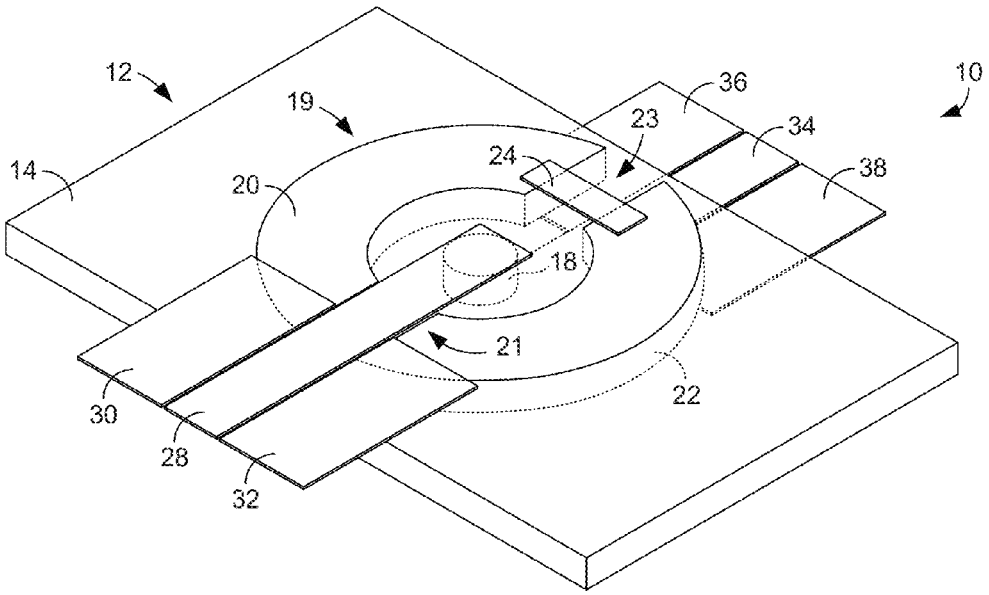
FIG. 1 is a top perspective view of an embodiment of a vertical microcoaxial interconnect.
Figure 2:
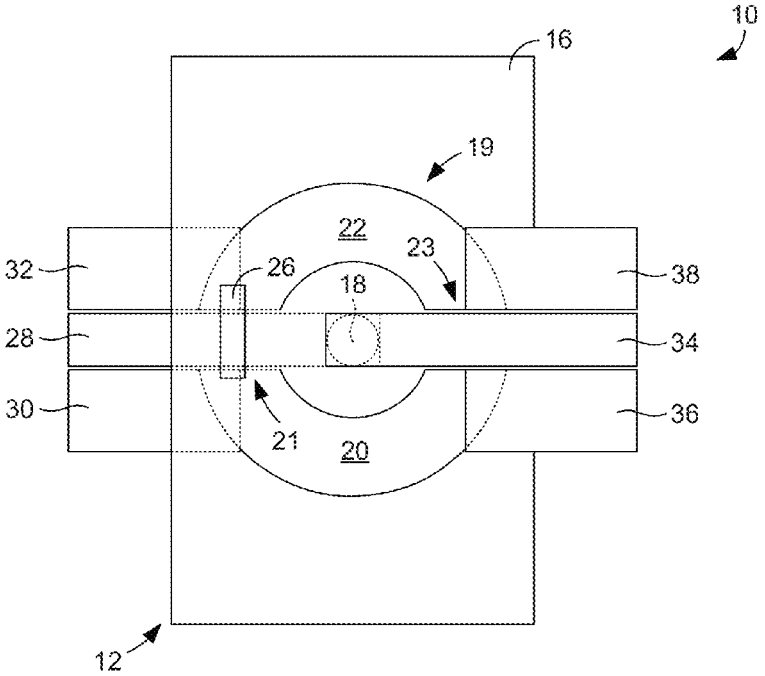
FIG. 2 is a bottom view of the interconnect of FIG. 1.

FIG. 1 illustrates an embodiment of a vertical microcoaxial interconnect 10. As shown in that figure, the interconnect 10 comprises a dielectric substrate 12 having a first or top side 14 and a second or bottom side 16 (FIG. 2). In some embodiments, the dielectric substrate 12 is made of high-resistivity silicon. It is noted, however, that other materials that inhibit the flow of electric current could be used to form the substrate 12. In some embodiments, the substrate 12 can be approximately 250 to 350 μm (e.g., 300 μm) thick and can be generally rectangular or circular.

Extending through the center of the substrate 12 from its top side 14 to its bottom side 16 is an inner conductor 18. The inner conductor 18 is made of an electrically-conductive material, such as a metal. In some embodiments, the metal is silver or gold. As is shown in FIG. 1, the inner conductor 18 can be rod-shaped and have a generally circular cross-section. In such cases, the inner conductor 18 can, for instance, have a cross-sectional diameter of approximately 50 to 150 μm (e.g., 100 μm).

The inner conductor 18 is surrounded by an outer conductor 19 in a coaxial relationship. The outer conductor 19 both facilitates higher packing density and electrically shields the inner conductor 18 using a metal-dielectric-metal topography. As shown in FIG. 1, the outer conductor 19 can comprise first and second lateral portions 20 and 22 that, like the inner conductor 18, extend through the substrate 12 from its top side 14 to its bottom side 16. Also like the inner conductor 18, the outer conductor 19 is made of an electrically-conductive material, such as silver or gold. The lateral portions 20, 22 can both be generally C-shaped such that they concentrically encircle the inner conductor 18 but form opposed first and second gaps 21 and 23 that prevent the outer conductor 19 from making contact with other conductors to prevent short circuiting. In some embodiments, the lateral portions 20, 22 lie within an outline of a generally circular ring having an inner diameter of approximately 250 to 350 μm (e.g., 300 μm) and an outer diameter of approximately 500 to 650 μm (e.g., 600 μm).

With further reference to FIG. 1, a first bridge 24 is provided on the top side 14 of the interconnect 10 that extends across the second gap 23 to electrically couple two of the ends of the lateral portions 20, 22. As is shown in the bottom view of FIG. 2, a second bridge 26 is provided on the bottom side 16 of the interconnect 10 that extends across the first gap 21 to electrically couple the other two ends of the lateral portions 20, 22. The bridges 24, 26 complete the circuit between the two lateral portions 20, 22 so that the outer conductor 19 forms a continuous conductive ring that encircles the inner conductor 18. Like the inner and outer conductors 18, 19, the bridges 24, 26 can also be made of an electrically-conductive material, such as silver or gold. As is described below, the outer conductor 19 can act as a ground for the interconnect 10. In some embodiments, the gaps 21, 23 are approximately 100 to 120 μm wide.

With reference back to FIG. 1, there are several conductive traces formed on the top side 14 of the substrate 12, which can also be made of a conductive metal such as silver or gold. These traces include a first central signal line 28 that extends to the inner conductor 18 and first and second ground lines 30 and 32 that border the signal line (without contacting it) and that respectively extends to the first and second lateral portions 20, 22 of the outer conductor 19. Together, the signal line 28 and the two ground lines 30, 32 form a ground-signal-ground configuration suitable for a coplanar waveguide (CPW) feed.

Referring to both FIGS. 1 and 2, there are also several conductive traces formed on the bottom side 16 of the substrate 12, which can also be made of a conductive metal such as gold. These traces include a second central signal line 34 that extends to the inner conductor 18 and third and fourth ground lines 36 and 38 that border the signal line (without contacting it) and that respectively extends to the first and second lateral portions 20, 22 of the outer conductor 19. The lines 34-38 also form a ground-signal-ground configuration.

In some embodiments, the interconnect 10 is formed by patterning the coaxial structure on the dielectric substrate 12 using photolithography. Via holes can be formed for the inner and outer conductors 18, 19 by etching through the patterned substrate 12 to create the proper length of interconnect. Once the via holes have been formed, they can be filled with a suitable conductive material.

With the configuration described above, signals can be transmitted along the first signal line 28, through the inner conductor 18, and then along the second signal line 34, or vice versa. The signals are shielded by the outer conductor 19, which is connected to ground via the ground lines 30 and 32 and/or 36 and 38. Because the signal lines 28 and 34 are separated from the ground lines 30, 32, 36, and 38 and the outer conductor 19 by dielectric material, the ground-signal-ground functionality is achieved.

Figure 3:
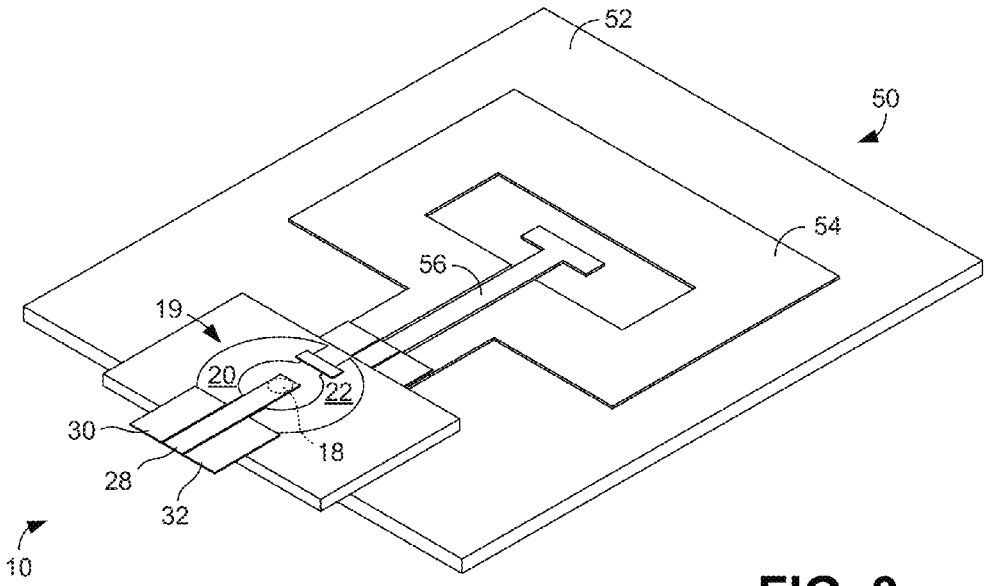
FIG. 3 is a top perspective view of the interconnect of FIG. 1 shown applied to a dipole antenna.

The vertical microcoaxial interconnect 10 can be used in many applications. For example, the interconnect 10 can be used to deliver signals from one integrated circuit level to another integrated circuit level. In other applications, the interconnect 10 can be used to evaluate the performance of passive electronic devices. FIG. 3 illustrates an example of this. In this figure, the interconnect 10 is shown mounted to a dipole antenna 50 that is formed on a separate substrate 52. As is shown in FIG. 3, provided on the substrate 52 is a ground plane 54 that surrounds an antenna signal line 56. When the interconnect 10 is coupled to the antenna 50 in the manner depicted in FIG. 3, the first signal line 28 of the interconnect is electrically coupled to the antenna signal line 56 via the inner conductor 18, while the first and second ground lines 30, 32 are electrically coupled with the ground plane 54 via the two lateral portions 20, 22 of the outer conductor 19. Once the interconnect 10 is so connected, it can be used to, for example, measure the performance of the antenna 50 and/or another device to which it is coupled. For instance, scattering parameters can be extracted from the interconnect 10 to determine the performance of the antenna 50.

Figure 4:
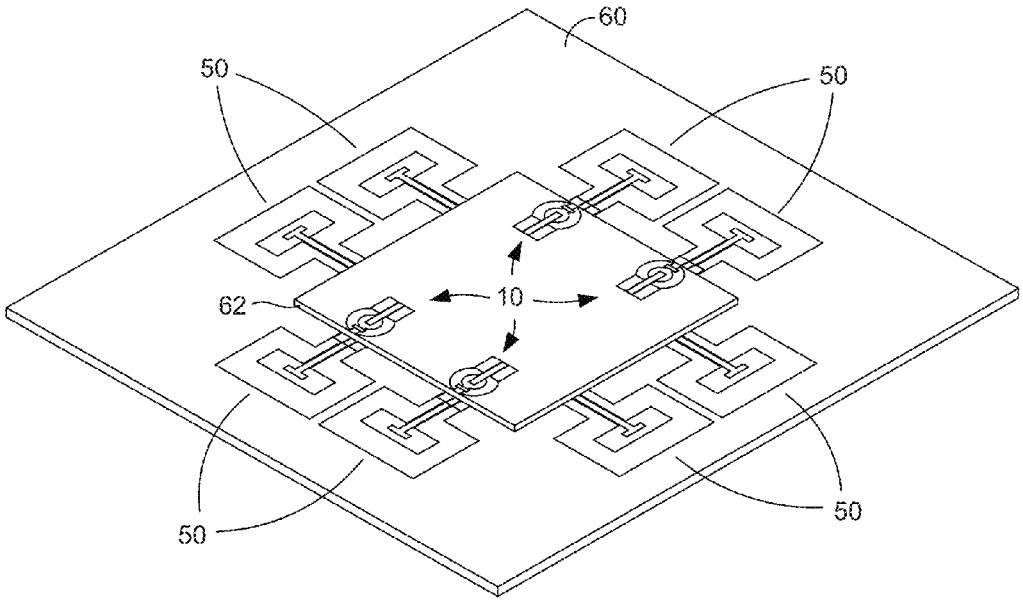
FIG. 4 is a top perspective view of multiple vertical microcoaxial interconnects applied to multiple antennas provided on a separate substrate.

FIG. 4 illustrates use of multiple vertical coaxial interconnects 10 in association with multiple dipole antennas 50 provided on a substrate 60. The interconnects 10 are provided on a separate substrate 62. In particular, two interconnects 10 are provided on both of two opposed sides of the substrate 62. With such a configuration, the four interconnects 10 can be used to simultaneously evaluate four different antennas 50. Once that evaluation has been completed, the substrate 62 can be rotated through 90 degrees with its plane, and the other four antennas 50 of the substrate 60 can similarly be simultaneously evaluated.

Figure 5A:
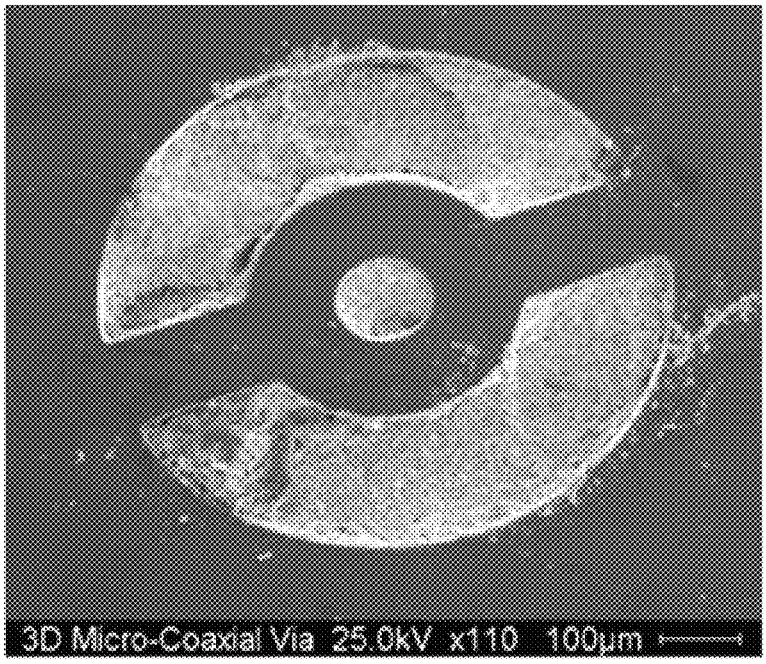
FIGS. 5A, 5B, and 5C are scanning electron microscope (SEM) images of a front side, a back side, and a cross-section, respectively, of a fabricated vertical microcoaxial interconnect.
Figure 5B:
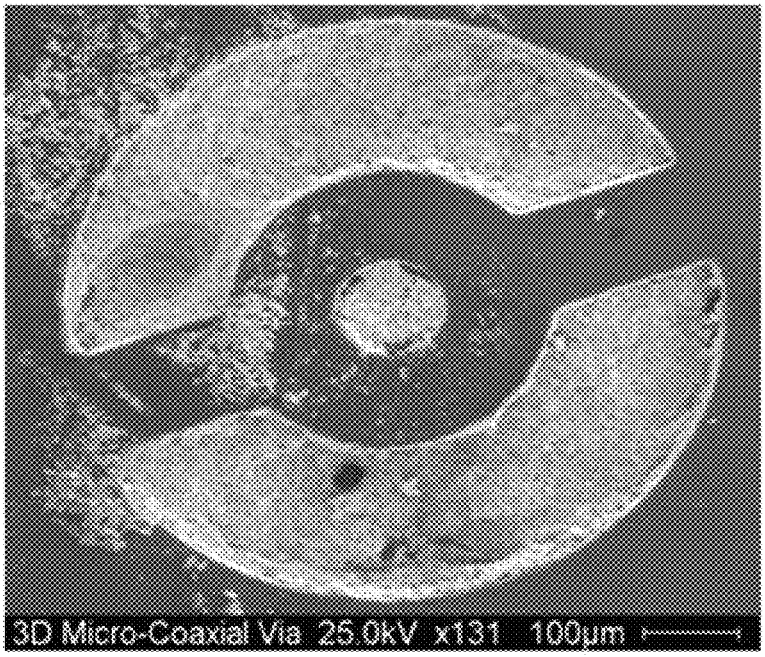
Figure 5C:
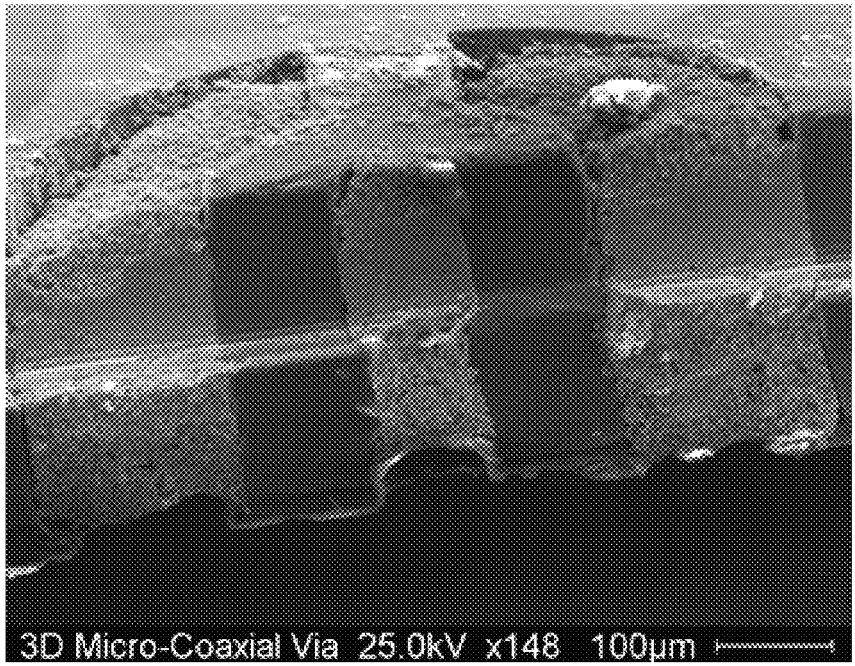

Vertical microcoaxial interconnects of the type described above were fabricated for testing purposes. During the fabrication, the microcoaxial structure was first patterned on a silicon substrate using standard photolithography techniques. Once the substrate was patterned, the exposed areas were etched to create the through-holes that will be used to form the inner and outer conductors. This was achieved using Bosch's process of deep reactive ion etching (DRIE) on the substrate. The etching process was performed for 30 minutes or until the holes were etched all the way through the substrate. Next, a metallization step was performed to fill the holes with silver paste. This was achieved using diluted silver paste, and a sharp razor blade was used to course the metal into the miniature holes. In this process, a thick amount of silver paste was applied to the substrate surface and the razor blade was swept across the holes, evenly distributing the metal inside the through-holes. FIGS. 5A and 5B are front and back side scanning electron microscope (SEM) images of the interconnect following the metallization of the holes using the diluted silver paste. FIG. 5C is an SEM image of a cross-section of the microcoaxial interconnect.

Figure 6:
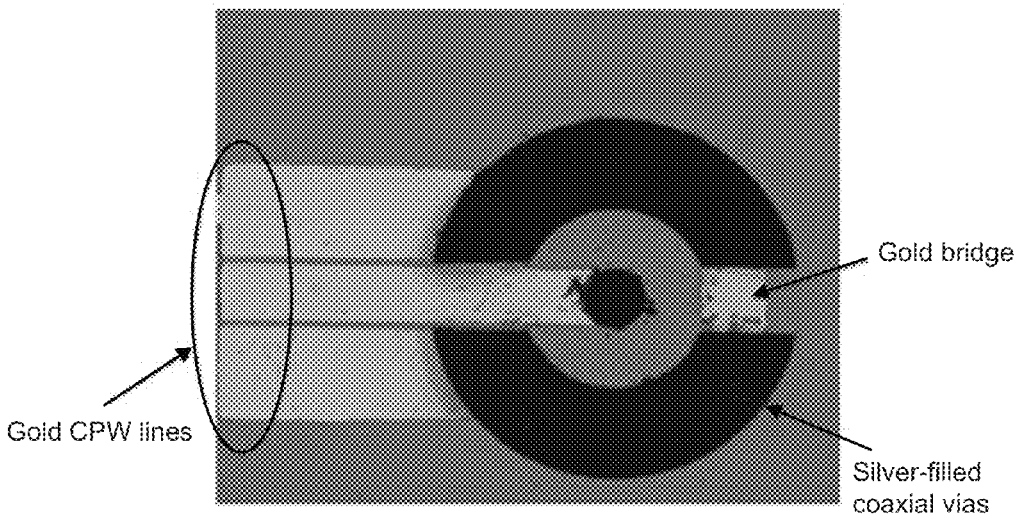
FIG. 6 is a microscopic image of the fabricated microcoaxial interconnect of FIGS. 5A-5C after deposition of gold coplanar waveguide (CPW) lines.

Next, an additional photolithography step was performed to pattern the CPW configuration lines on the top and bottom sides of the substrate. The substrate with its metalized through-holes was spin-coated with NR9-3000PY negative photoresist at 1,000 rpm for 30 seconds at 20 acceleration and then soft-baked for 1 minute at 150° C. Following this, the substrate was exposed using a Karl Suss mask aligner for 23 seconds at 25 mw/cm$^2$ and hard-baked for 1 minute at 100° C. The substrate was then developed in RD6 for 10 seconds. After this lithography process, an electron beam evaporator was used to deposit the metal on the CPW line patterns. First a chrome layer of approximately 15 nm was deposited at a rate of 0.3 A/sec and acted as an adhesion layer for the top gold layer. The gold layer had a thickness of approximately 300 nm and was deposited at a rate of 2 A/sec. Finally, a liftoff process was performed by placing the substrate in acetone overnight, which removed the remaining gold from the silicon surface. FIG. 6 is a microscopic image of the fabricated vertical microcoaxial interconnect with gold CPW lines.

Figure 7A:
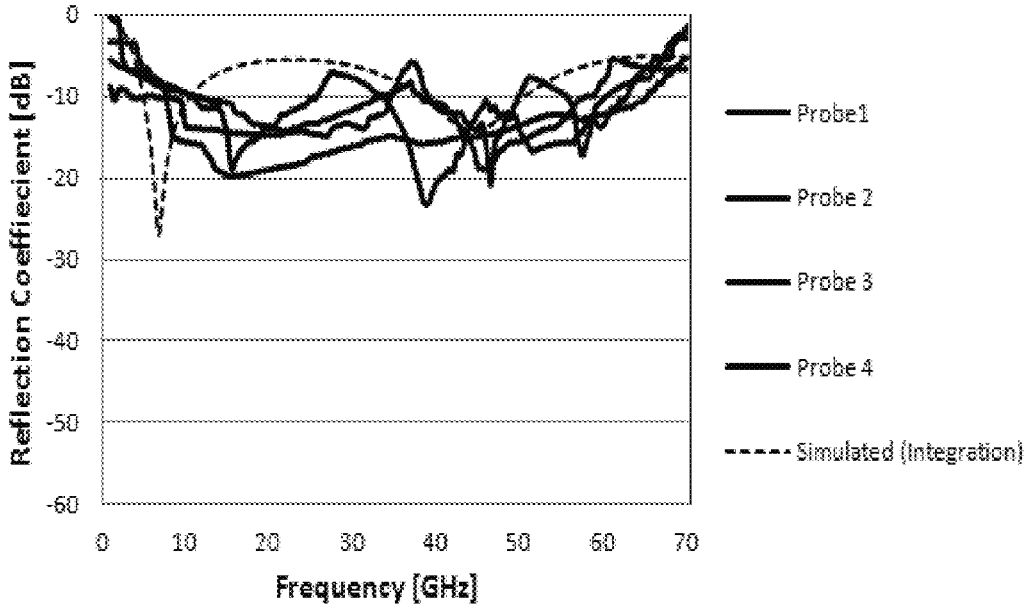
FIGS. 7A and 7B are graphs that show measured results of a fabricated microcoaxial interconnect versus a simulated response for (A) reflection coefficient and (B) insertion loss.
Figure 7B:
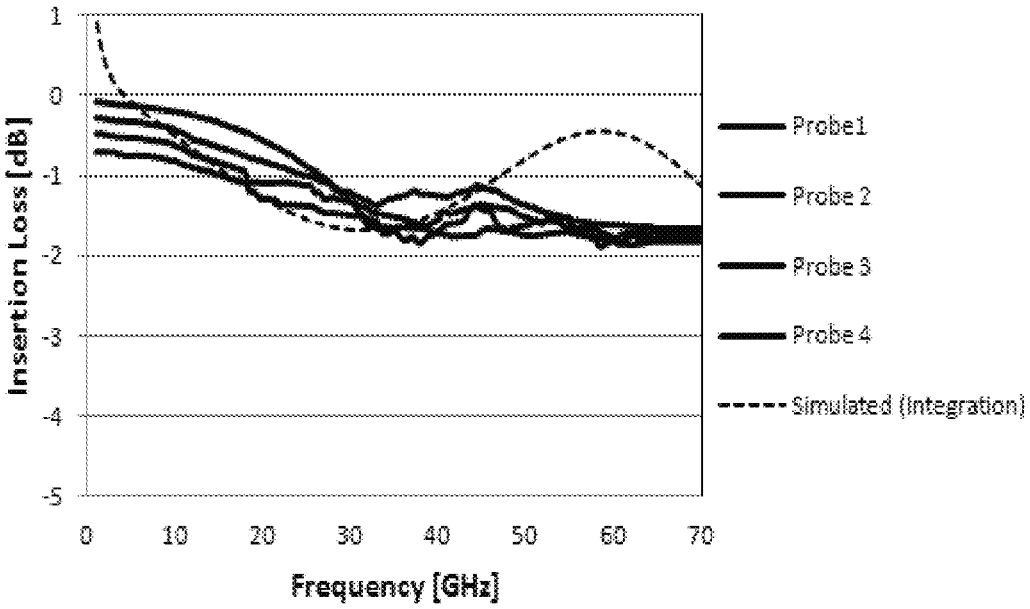

Testing was performed on the fabricated vertical microcoaxial interconnect over a wide frequency range from dC-to-65 GHz using a vector network analyzer (VNA). The measured results of the microcoaxial interconnect are shown in FIGS. 7A and 7B. When measuring the reflection coefficient, most of the interconnects demonstrated good results as compared to simulations with more than a −10 dB loss difference at high frequencies from approximately 15 GHz to 57 GHz. When measuring the insertion loss, all four tested interconnects behaved well from dc-to-40 GHz, demonstrating less than −1.5 dB loss, which was very close to the simulated results. This proves that the microcoaxial interconnects have good signal transmission between the two ports and would provide minimal loss when characterizing passive electronic devices.

The invention claimed is:

1. A vertical microcoaxial interconnect comprising:

a dielectric substrate having a top side and a bottom side;

an inner conductor extending through the substrate from its top side to its bottom side;

an outer conductor that extends through the substrate from its top side to its bottom side, the outer conductor comprising first and second generally C-shaped lateral portions whose ends are separated by opposed gaps and that concentrically encircle the inner connector;

a bridge that crosses one of the gaps to join two ends of the C-shaped lateral portions;

a first signal line formed on the top side of the substrate and extending to the inner conductor without contacting the outer conductor or the bridge;

a second signal line formed on the bottom side of the substrate and extending to the inner conductor without contacting the outer conductor or the bridge; and a ground line extending to the outer conductor without contacting the inner conductor or the signal line.

2. The interconnect of claim 1, wherein the inner conductor is rod-shaped and has a generally circular cross-section.

3. The interconnect of claim 2, wherein the inner conductor has a diameter of approximately 50 to 150 microns.

4. The interconnect of claim 1, further comprising a second bridge that crosses the other gap to join two other ends of the C-shaped lateral portions.

5. The interconnect of claim 4, wherein the first bridge is provided on the top side of the substrate and the second bridge is provided on the bottom side of the substrate.

6. The interconnect of claim 1, wherein the dielectric substrate is made of high-resistivity silicon.

7. The interconnect of claim 1, wherein the dielectric substrate is approximately 250 to 350 microns thick.

8. The interconnect of claim 1, wherein the gaps are approximately 100 to 120 microns wide.

9. The interconnect of claim 1, wherein the first and second lateral portions lie within an outline of a generally circular ring having an inner diameter of approximately 250 to 350 μm and an outer diameter of approximately 500 to 650 μm.

10. The interconnect of claim 1, wherein the signal line and the ground line are formed on the top side of the substrate and wherein the interconnect further comprises a further signal line and a further ground line formed on the bottom side of the substrate, wherein the further signal line extends to the inner conductor and the further ground line extends to the outer conductor.

11. A vertical microcoaxial interconnect comprising:

a dielectric substrate having a top side and a bottom side;

a rod-shaped inner conductor extending through the substrate from its top side to its bottom side, the inner conductor having a generally circular cross-section;

an outer conductor that extends through the substrate from its top side to its bottom side, the outer conductor having first and second C-shaped lateral portions whose ends are separated by opposed gaps, the lateral portions lying within an outline of a generally circular ring and concentrically encircling the inner conductor;

a first bridge that crosses one of the gaps to join two ends of the C-shaped lateral portions;

a second bridge that crosses the other gap to join two other ends of the C-shaped lateral portions;

a first signal line provided on the top side of the substrate and extending to the inner conductor without contacting the outer conductor;

first and second ground lines provided on the top side of the substrate and extending to respective lateral portions of the outer conductor without contacting the inner conductor or the signal line and not being in direct physical contact with the first and second bridges;

a second signal line provided on the bottom side of the substrate and extending to the inner conductor without contacting the outer conductor; and third and fourth ground lines provided on the bottom side of the substrate and extending to respective lateral portions of the outer conductor without contacting the inner conductor or the signal line and not being in direct physical contact with the first and second bridges.

12. The interconnect of claim 11, wherein the dielectric substrate is approximately 250 to 350 microns thick.

13. The interconnect of claim 11, wherein the inner conductor has a diameter of approximately 50 to 150 microns.

14. The interconnect of claim 11, wherein the gaps are approximately 100 to 120 microns wide.

15. The interconnect of claim 11, wherein the outer conductor defines an inner diameter of approximately 250 to 350 μm and an outer diameter of approximately 500 to 650 μm.

* * * * *